US006189846B1

(12) United States Patent
Wang

(10) Patent No.: US 6,189,846 B1
(45) Date of Patent: Feb. 20, 2001

(54) TREADMILL HORIZONTAL, VERTICAL SUPPORT MECHANISM

(76) Inventor: Leao Wang, No. 1, Lane 154, Charng Long Rd., Taiping City, Taichung (TW)

( * ) Notice: Under 35 U.S.C. 154(b), the term of this patent shall be extended for 0 days.

(21) Appl. No.: 09/182,237

(22) Filed: Oct. 30, 1998

(51) Int. Cl.[7] ..... F16M 11/20
(52) U.S. Cl. ..... 248/188.1; 248/649; 482/54
(58) Field of Search ..... 248/188.1, 188.4, 248/188.5, 188.8, 188.6, 188.7, 649, 677, 688, 188.9, 188.2; 482/54; 272/69

(56) References Cited

U.S. PATENT DOCUMENTS

| | | | | |
|---|---|---|---|---|
| 4,576,352 | * | 3/1986 | Ogden | 248/188.4 |
| 4,659,074 | * | 4/1987 | Taitel et al. | 272/69 |
| 4,664,371 | * | 5/1987 | Viander | 248/188.5 X |
| 5,029,801 | * | 7/1991 | Dalabout et al. | 248/649 |
| 5,058,881 | * | 10/1991 | Measom | 272/69 |
| 5,484,362 | * | 1/1996 | Skowronski et al. | 482/54 |
| 5,503,609 | * | 4/1996 | Bull | 482/70 |
| 5,518,471 | * | 5/1996 | Hettinger et al. | 482/54 |
| 5,591,106 | * | 1/1997 | Dalebout et al. | 248/649 |
| 5,626,538 | * | 5/1997 | Dalebout et al. | 482/54 |
| 5,733,228 | * | 3/1998 | Stevens | 482/54 |
| 5,816,981 | * | 10/1998 | Hung | 482/54 |
| 5,921,892 | * | 7/1999 | Easton | 482/54 |
| 5,964,681 | * | 10/1999 | Stevens | 482/54 |
| 6,050,922 | * | 4/2000 | Wang | 482/54 |

* cited by examiner

*Primary Examiner*—Ramon O. Ramirez
*Assistant Examiner*—Tan Le
(74) *Attorney, Agent, or Firm*—Dougherty & Troxell

(57) ABSTRACT

A support device that helps to anchor a treadmill in horizontal and upright positions. The support mechanism has two pads and two anchors that are separately attached to the frontal horizontal tubing and along the front of the frame. When the treadmill frame is placed horizontally in an operative mode, the pads provide close contact with the ground surface so that the entire device is stable and unmoving. An auxiliary support is also incorporated in the upper front so that when the treadmill is placed vertically in a folded state, the support anchors at the front of the frame can position the treadmill in an upright position firmly to prevent incidental free-fall to ensure greater safety.

3 Claims, 4 Drawing Sheets

TREADMILL HORIZONTAL, VERTICAL SUPPORT MECHANISM

BACKGROUND OF THE INVENTION

1. Field of the Invention

The preferred embodiment proposed in this invention pertains to incorporating a treadmill support device, particularly referring to a folding condition that provides a sure way to stabilize the runner frarne, whether it be positioned horizontally in an operative mode, or in a vertical folded state to achieve sound and stable support function, that further provides comfortability and safety features of an innovative invention.

2. Description of the Prior Art

Pursuant to the basic design deployed in most common treadmills due to bulky dimension and volume that tends to take up considerable space, thus most of them have been incorporated with the feature of having the frame flipped vertically in a folded condition so to reduce its bulk and the space that it takes up. Therefore, it has become a critical consideration in terms of how to ensure its stability when the treadmill is flipped to an vertical upright position or else it may be prone to fall down causing incidental occurrence that may endanger the safety of people.

SUMMARY OF THE INVENTION

With the above consideration in mind, the inventor, being aware of the situations described above, has broached the issue from the angle of safety, combined with years of practical know-how, to instigate further research and developing aggressively so to reveal pertinent techniques to the market place. It primarily pertains to incorporating a support function that provides a sound and stable condition of a treadmill whether is be in a horizontal, operative condition, or in vertical upright state of a folded condition that further provides comfortability and safety, and prevent casters from moving around as the prim-e design objective of this invention.

BRIEF DESCRIPTION OF THE DRAWINGS

To provide in-depth understanding to the im-plemienting techniques and structural features proposed by the invention, following drawings are provided to outlined below.

DETAILED DESCRIPTION OF THE INVENTION

Figure 1:
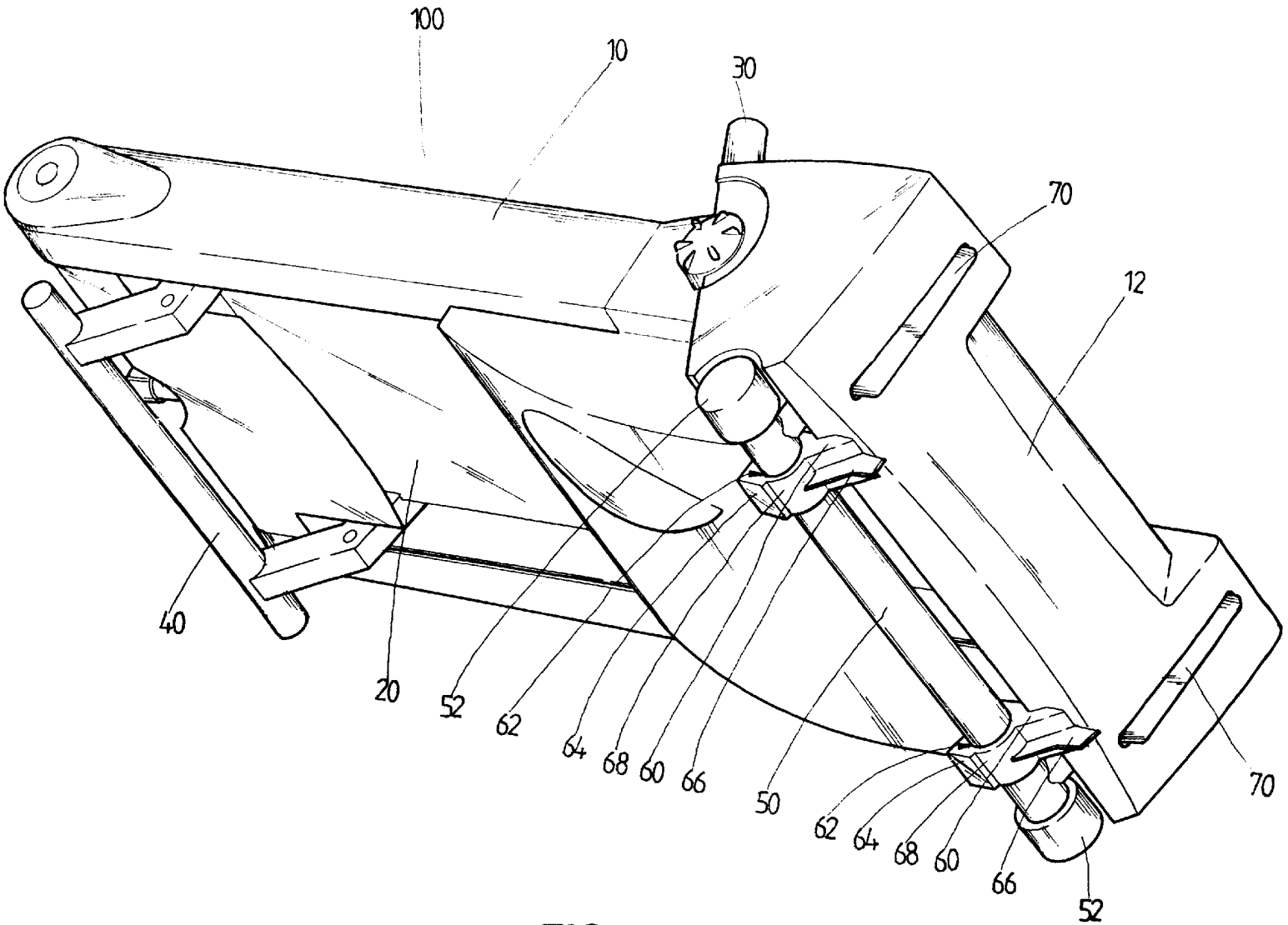
FIG. 1: A three-dimensional perspective view of a treadmill frame illustrating the p53 resent invention.
Figure 2:
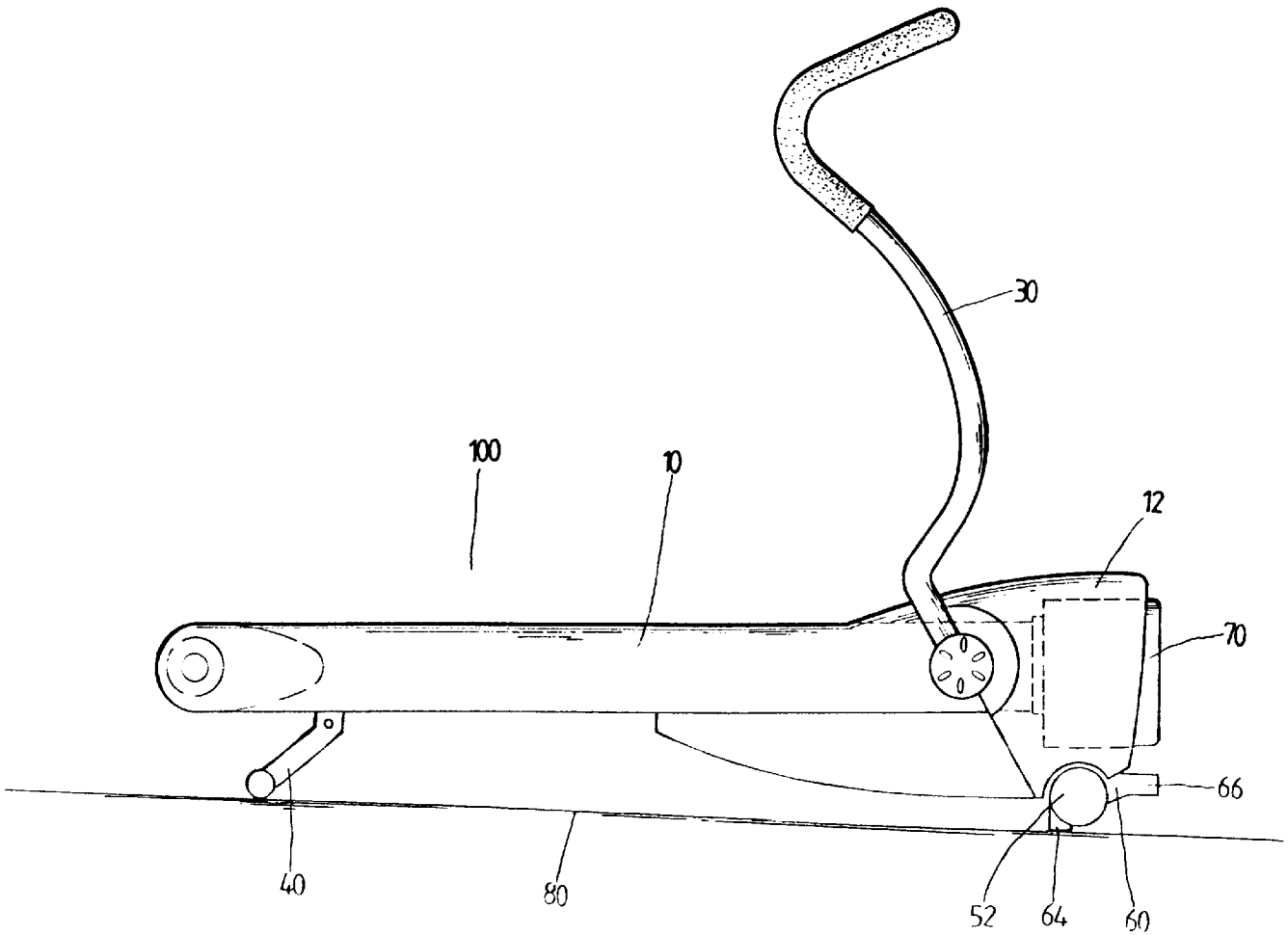
FIG. 2: A side view of a treadmill frame in a horizontal operative condition incorporating the present invention.

To start, please refer to FIG. 1, where a common treadmill 100 usually contains basic components including a frame 10, a runner belt 20, handrails 30, a rear lever 40 and a front lever 50. Now please proceed to FIG. 2, which indicates that the support device referred in this invention primarily concerns two pads 60 and two anchors 70, which are separately installed at the frontal horizontal tubing 50 and at an adequate spot along the two sides toward the front of the frame 10. In which, the pads 60 are placed over the frontal horizontal tubing 50 via the center opening 62 on them, with their rear touching the ground contact 64. So when frame 10 is placed horizontally in an operative mode, the pads 60 provide close contact with the ground surface 80 so the treadmill 100 is sound and unshaking. In addition, the upper part of the front is equipped with an auxiliary support 66 extended toward the front.

The said support device 70 is of a slide configuration, which is installed at the front edge of the frame 10, and it is so positioned that it exactly extends out of the cover 12.

Figure 3:
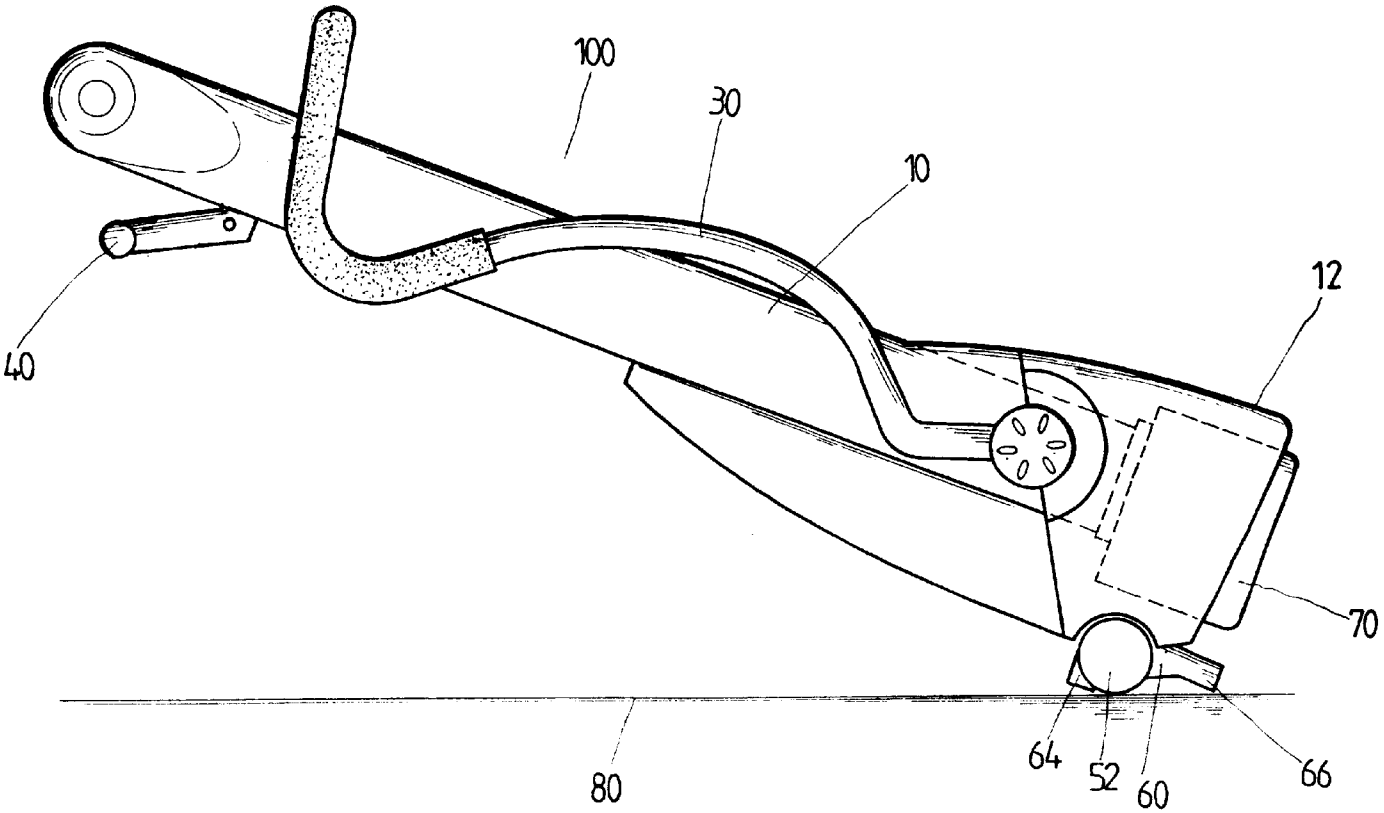
FIG. 3: A side view of the treadmill frame in FIG. 2 in a slanted position.

Therefore, as shown in FIG. 3, because the space between the ground contact 64 of the pads 60 and the support 66 of the auxiliary anchor contain an adequately concave distance 68; therefore, when the frame 10 is lifted to a certain angle in a slanted position, no parts of the pads 60 will come in contact with the ground surface 80. At this time, the casters 52 are touching the ground 80, thus enabling a user to move the treadmill 100 around.

Figure 4:
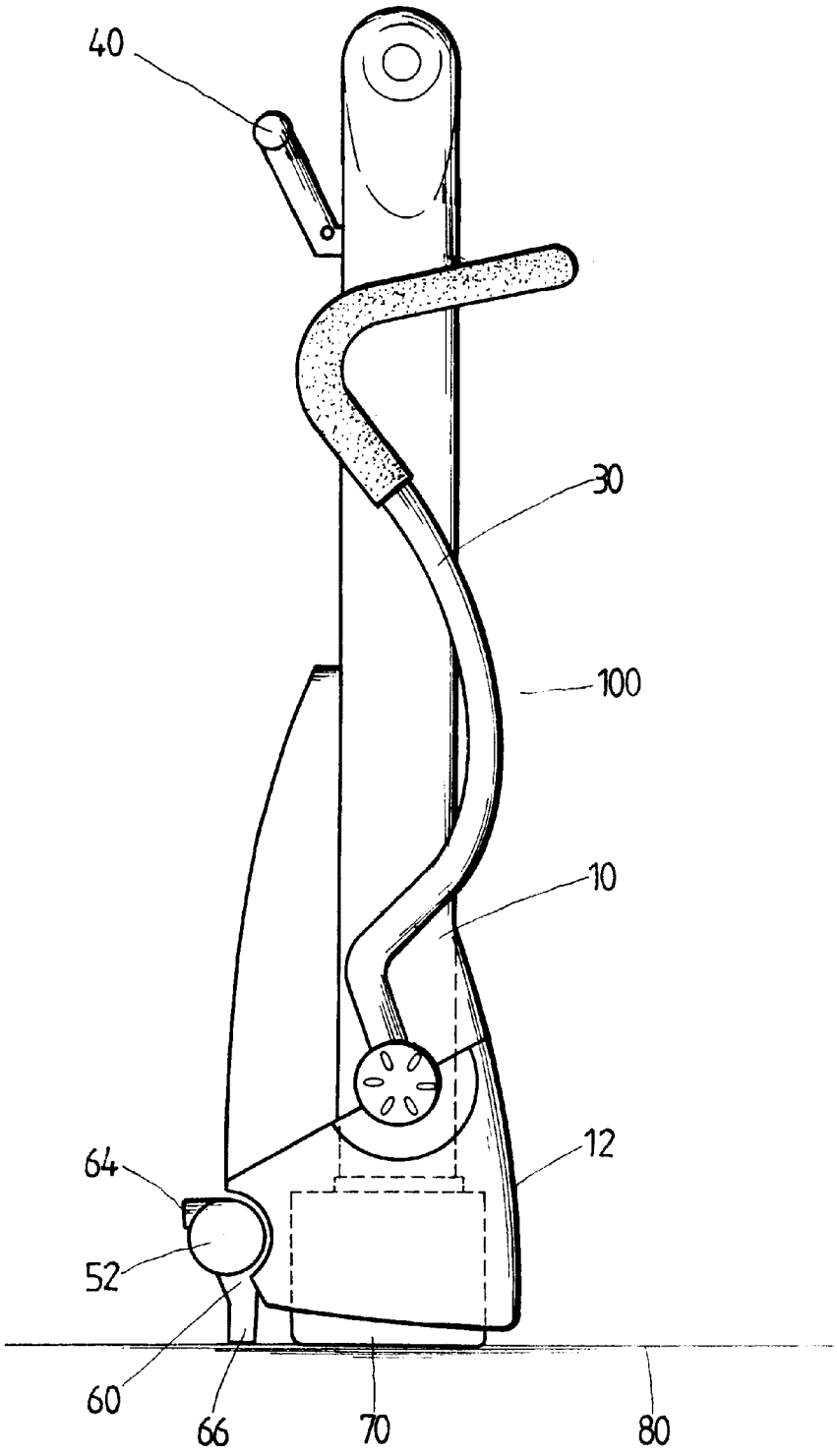
FIG. 4: A side view of the treadmill frame in FIG. 2 in an upright folded position.

Thereafter, please refer to FIG. 4, as we continue to life the frame 10 to a vertical position in a folded state, the auxiliary support 66 of the pads 60 and the front of the anchors 70 will touch the ground so as to provide more traction over the resting area to ensure the treadmill 100 in a sound and freestanding state to prevent incidental free-fall and to further ensure personnel safety.

Recapping the above described, what has been claimed by this invention has not yet been found in any similar products sold in the market place or revealed in any publication or research data, thus indeed contains innovative and progressive practical values, which also meet the criteria of applying for a new model patent listing that deserves to be protect by the law, hence an application has thus been submitted according to applicable law.

What is claimed is:

1. A mechanism for stably supporting a treadmill in both a use position and a folded position, and comprising:

a) a frame with a front surface and having a running belt thereon, the frame being movable between a use position and a folded position;

b) a support lever on the frame adjacent to a front of the frame, the support lever having casters thereon supporting the front of the frame on a support surface;

c) a plurality of pads mounted on the support lever, each pad having a ground contact portion and an auxiliary support portion positioned such that the ground contact portions contact the support surface when the frame is in the use position to stably support the frame, and the auxiliary support portion extends forwardly beyond the front surface of the frame, both the ground contact portion and the auxiliary support portions being out of contact with the support surface when the frame is in a position between the use and folded positions; and, d) at least one support device extending forwardly of the front surface of the frame such that the film is supported solely by the at least one support device and the auxiliary support portions when in the folded position.

2. The mechanism for supporting a treadmill of claim 1 further comprising a plurality of spaced apart support devices extending forwardly of the front surface of the frame.

3. The mechanism for supporting a treadmill of claim 1 wherein each of the plurality of pads has an opening through which the support lever extends.

* * * * *